US005176196A

United States Patent [19]

Denis

[11] Patent Number: 5,176,196

[45] Date of Patent: Jan. 5, 1993

[54] METHOD AND APPARATUS FOR FEEDING LIQUID METAL INTO A MOLD

[75] Inventor: Jean-Pierre Denis, Nancy, France

[73] Assignee: Pont-A-Mousson S.A., Nancy, France

[21] Appl. No.: 519,537

[22] Filed: May 4, 1990

[30] Foreign Application Priority Data

May 5, 1989 [FR] France ..... 89 06167

[51] Int. Cl.[5] ..... B22D 18/04; B22C 9/02

[52] U.S. Cl. ..... 164/34; 164/257; 164/63

[58] Field of Search ..... 164/34, 35, 254, 257, 164/63

[56] References Cited

U.S. PATENT DOCUMENTS 2,082,588 6/1937 Menetrey ..... 164/254
4,616,689 10/1986 Denis ..... 164/34
4,693,292 9/1987 Campbell ..... 164/34
4,804,032 2/1989 Wilkins ..... 164/34

FOREIGN PATENT DOCUMENTS 1210137 2/1966 Fed. Rep. of Germany ..... 164/254
1208726 2/1960 France ..... 164/254
63-278658 11/1988 Japan ..... 164/63

*Primary Examiner*—Richard K. Seidel
*Assistant Examiner*—Rex E. Pelto
*Attorney, Agent, or Firm*—Sughrue, Mion, Zinn, Macpeak and Seas

[57] ABSTRACT

A mold containing a gasifiable or vaporizable disposable pattern 3, embedded in sand 4 without a binding agent, is fed through its base by a pressurized chamber 6 containing liquid cast metal. The pressure in the chamber 6 is regulated as a function of the surface area/volume ratio of the disposable pattern 3 to prevent the emergence of high-gloss carbon.

6 Claims, 2 Drawing Sheets

METHOD AND APPARATUS FOR FEEDING LIQUID METAL INTO A MOLD

BACKGROUND OF THE INVENTION

This invention concerns a method and apparatus for feeding a liquid ferrous alloy to a mold made up of a gasifiable disposable pattern embedded in an unbound granular molding material, which prevents the appearance of the high-gloss carbon phenomenon.

In equipment of this kind, a gasifiable disposable pattern made of expanded polystyrene is used for each casting. Once produced, this pattern is covered with a heat-resistant coating and then placed in a mold where it is embedded in a granular material, generally sand, which is compressed by vibration. The mold is then fed with liquid metal, which vaporizes and displaces/replaces the gasifiable disposable pattern. This procedure is known by the general name of full mold casting.

When objects made of high fusion-point ferrous alloys such as cast iron or steel are manufactured, the material of the disposable pattern is not always completely vaporized. Furthermore, it frequently happens that the components of the disposable pattern, which have been vaporized in an initial stage, partially recondense later. In both cases, carbonaceous residues form at the surface of the molded part.

In the case of objects having a low carbon content, such as steels, the carbonaceous residues dissolve in the liquid metal. Even in this case, however, the consequences are not negligible because a carbonaceous gradient then appears in the object, whose surface is richer in carbon than its body.

Thus, objects made of a steel containing a low free carbon content could not, until now, be manufactured using the full mold casting process described above.

In the case of objects made of high-carbon steel, such as ductile cast iron, the consequences are even more pronounced. In fact, the phenomenon conventionally termed high-gloss carbon appears. It occurs randomly as discontinuities in the thickness and as irregularities in the surface of the molded object, and these discontinuities damage the object's solidity.

Thus, until now, there was no procedure or device making it possible to manufacture, simply and reproducibly, ductile cast iron objects possessing marked mechanical properties using the full mold casting process, which makes use of a gasifiable disposable pattern in expanded polystyrene or any other material which decomposes while producing carbon residues.

To compensate for the appearance of high-gloss carbon and for the diffusion of the carbon in the molded object, it has been suggested that the material of the disposable pattern be changed. For this reason, polymethyl methacrylate replaced polystyrene. When subjected to pyrolysis within the temperature range of the ferrous alloys, polymethyl methacrylate vaporizes completely but produces no carbon residues. However, while this product eliminates the emergence of high-gloss carbon, it poses other problems. Indeed, in addition to the problem of cost, polymethyl methacrylate appears to be less solid than polystyrene, thereby requiring increased precautions when handling the pattern, and furthermore, it generates a greater quantity of gas, leading potentially to a backflow of the liquid metal fed to the mold, thus doubling the mold filling time.

SUMMARY OF THE INVENTION

An object of this invention thus consists of providing a method and apparatus for the manufacture of objects made of ferrous alloys using the full mold casting process, in which the gasifiable disposable pattern is made of a material which produces carbon residues within the range of casting temperatures for the ferrous alloy. This method and apparatus eliminate the problems linked to the production of these carbon residues, by preventing the emergence of high-gloss carbon.

DETAILED DESCRIPTION OF THE PREFERRED EMBODIMENT

The applicant has discovered that, under certain conditions, the use of equipment for the feed of liquid cast iron to the mold, of the type described in French patent No. 2,295,808, makes it possible to avoid the emergence of high-gloss carbon.

Figure 1:
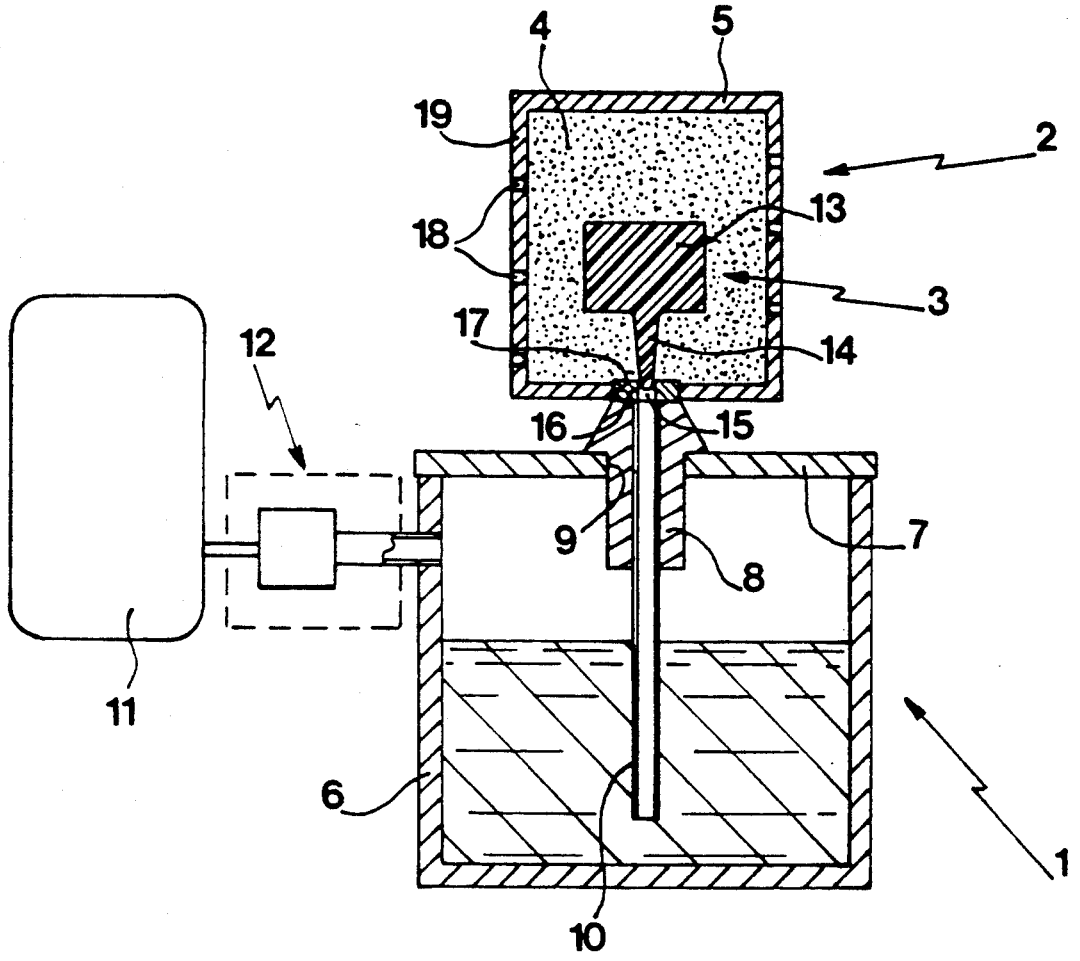
FIG. 1 is a sectional elevation of a full mold casting apparatus operating in accordance with the method of the invention.

Thus, as illustrated in FIG. 1, the equipment operating according to the invention comprises a liquid cast metal feed apparatus 1 designed to supply a mold 2 having a gasifiable disposable pattern 3 embedded in sand 4 in the absence of a binding agent within a box 5. The equipment comprises a gas-pressurized chamber 6 within which a reservoir of the liquid cast metal intended to supply the mold 2 is carried. The chamber 6 comprises a cover 7 attached impermeably to the chamber, and a casting nozzle 8 which passes through an opening 9 in the cover 7, the junction between the nozzle 8 and the cover 7 being also water-tight. A plunger tube 10, which is immersed in the liquid cast metal until it reaches the vicinity of the floor of the chamber 6, passes through the entire vertical length of the nozzle 8. The chamber 6 is connected by a circuit 12 to a pressurized gas source 11 composed of a tank fed with pressurized gas.

The gasifiable disposable pattern 3 made of expanded polystyrene comprises two parts, one part 13 matching the shape of the object to be produced and another part 14 forming the casting well through which the liquid metal flows to supply the attack points of the object to be produced. This gasifiable disposable pattern 3 is positioned by means of its part 14 in an opening 15 drilled in an insert 16 made of heat-resistant material, the insert 16 being immovably attached in an opening 17 cut in the base of the box 5.

As seen in FIG. 1, the casting nozzle 8 is designed to fit against the insert 16 of the frame 5 at its upper end to form a water-tight seal. In this arrangement, the plunger tube 10 connects with the opening 15 in the insert 16. Openings 18 are cut in the lateral walls 19 of the box 5 to allow the box to be connected to an external vacuum source, not shown, to facilitate the evacuation of gases released by the pattern 3 as it melts and vaporizes. The box 5 would also have a removable top, bottom or side wall, not shown, to enable the placement of the pattern 3 and sand 4, and the removal of the cast object. Means for charging the chamber 6 with molten cast iron would, of course, also be provided, but this feature has not been shown as it forms no part of the invention.

Figure 2:
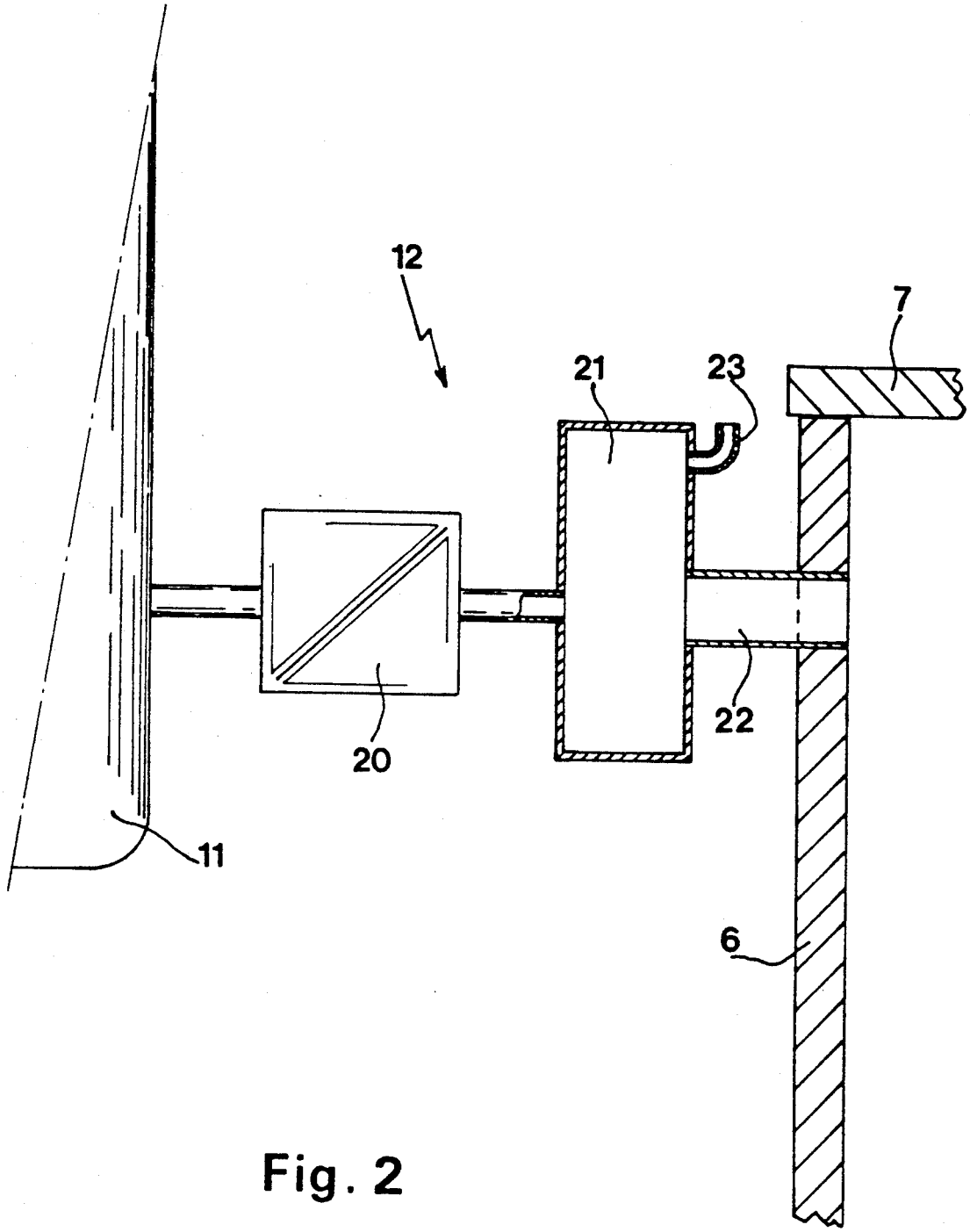
FIG. 2 is a sectional elevation of the pressure-regulation circuit according to the invention.

As seen in FIG. 2, the circuit 12 incorporates a regulating device 20 comprising one or more electrovalves or solenoid valves which control the connection between the chamber 6 and the pressurized gas source 11. The regulating device 20 is connected to a computer, not shown, which continuously compares the sensed pressure in the chamber 6 to a reference pressure.

A gas reservoir 21 is installed between the regulating device 20 and the chamber 6. It acts as a buffer capacity connected to the chamber 6 by a large-diameter duct 22, and has a continuous escape valve 23 of comparatively small diameter.

According to the conventional operation of casting equipment, such as that described in the French '808 patent, the nozzle 8 is fitted against the insert 16 of the box on the lower surface of the latter, forming a watertight seal. Following this, the pressure P in the chamber 6 containing the liquid cast iron is increased at a certain speed dP/dT (T representing time), in such a way that the liquid cast metal contained in the chamber rises in the plunger tube and enters the box 5 at a given rate through the opening 15 in the insert 16. The disposable pattern 3 then vaporizes under the action of the heat of the liquid cast metal injected into the mold 2 as the mold fills up. It was at this mold filling stage that, in the prior art, the high-gloss carbon phenomenon appeared.

The applicant has found, without being able to offer an explanation, that by regulating the feed flow rate of the liquid metal into the mold, this phenomenon disappears. Indeed, the applicant has discovered that the optimal flow rate of the liquid cast iron fed to the mold allowing an object free of high-gloss carbon to be cast depends on the geometry of the gasifiable disposable pattern and, more particularly, on its S/V ratio. S being the surface area of the disposable pattern and V, its volume. It appears, in effect, that the lower the S/V ratio the more extensive the appearance of high-gloss carbon, all other factors being equal, but that if the feed flow rate to the mold is increased to a certain value, the phenomenon disappears.

The procedure according to the present invention therefore consists in producing an object made of ductile cast metal in a mold formed from a disposable pattern of expanded polystyrene embedded in sand in the absence of a binding agent, the mold being fed with liquid cast iron through its base by means of a feed device comprising a pressurized chamber containing the liquid cast iron, in which the feed flow rate of the liquid cast iron to the mold is calculated based on the S/V ratio of the gasifiable disposable pattern, in such a way that no high-gloss carbon phenomenon appears.

To achieve this, the pressure inside the chamber 6 must be totally regulated, but no previous device provided this regulating capacity. The regulating device 20 makes this process possible.

In effect, when one wishes to regulate the pressure within a pouring ladle, the temperatures reached by the gases in the ladle require that any electrovalves be moved away from it to prevent their gaskets from burning during the pressure-decrease phases which occur once the mold is filled. This results in a time constant or delay factor which adversely affects pressureregulation stability. With this invention, however, because of the reservoir 21 which acts as a buffer tank, the pressure in the reservoir 21 is fully regulated by the electrovalves, and the connection to the pressurized chamber 6 by a large-diameter duct 22 thus limits load losses. In this way, the reservoir 21 allows any gases emanating from the chamber 6 to cool to an acceptable temperature allowing the proper operation of the electrovalves.

Another regulation problem results from the fact that the gases introduced into the chamber 6 heat up and expand, thereby leading to an undesirable increase in pressure in the chamber 6 after the injection of gas has ceased. Because of the continuous escape valve 23 installed on the reservoir 21, however, which acts as a buffer tank, the system of the invention is continuously maintained at full supply during all mold-filling phases.

By way of actual examples, to make a valve body whose casting weight is 17 kg in a full mold fed by a casting apparatus as described above, the liquid cast metal in the ladle had a temperature of between 1.420° and 1.460° C. and feed flow rates to the mold of 1 kg/s and 3.3 kg/s produced defective objects, while a rate of 5.7 kg/s produced an object entirely without flaws. This illustrates indeed that, by regulating the pressure in the feed ladle and, therefore, the flow feed rate in a full mold process, a part made of ductile cast metal free from high-gloss carbon may be obtained.

Furthermore, a flawless escape head was made weighing 2.1 kg at a feed flow rate of 3.3 kg/s, thereby demonstrating that the optimal flow rate depends on the geometry of the part and, therefore, of the gasifiable disposable pattern.

The above invention is applicable in the same manner and with equal success to a mold designed for the manufacture of a single part and a mold designed for multiple objects. In the latter case, the gasifiable disposable pattern is made up of several parts corresponding to the various objects to be produced, which are arranged in a cluster after the feed well 14.

I claim:

1. A method for the manufacture of an object from ductile liquid cast metal in a mold (2) including a gasifiable disposable pattern (3) having a configuration corresponding to that of the object to be manufactured and made of a material which produces carbon residues within the range of cast metal casting temperatures, said pattern being embedded in sand (4) in the absence of a binding agent, comprising the steps of: feeding the mold with liquid cast metal through a base thereof by means of a feed device comprising a pressurized chamber (6) containing liquid cast iron, and regulating the pressure in the pressurized chamber to attendantly regulate the feed flow rate of the liquid cast metal into the mold to prevent the occurrence of a high-gloss carbon phenomenon, wherein the pressure in the pressurized chamber is regulated as a function of the S/V ratio of the gasifiable disposable pattern, S being the surface area of the disposable pattern and V, the volume thereof.

2. A method according to claim 1, wherein the pressure in the pressurized chamber is regulated by modifying the pressure in a buffer reservoir (21) connected to said pressurized chamber (6).

3. An apparatus for casting an object from ductile liquid metal, comprising:

a) a mold housing (5), b) a vaporizable disposable pattern (3) disposed within the housing, made of a material which produces carbon residues within a range of casting temperatures of the liquid metal, having a configuration corresponding to that of the object to be cast, and embedded in sand (4) in the absence of a binding agent, c) a pressurized chamber (6) containing liquid cast iron, d) means (10, 14–16) for feeding the liquid cast iron vertically upwardly from the chamber into the mold housing through a base thereof to displace and vaporize the disposable pattern, and e) means for regulating the pressure in the chamber and attendantly the feed flow rate of the liquid cast iron into the mold housing as a function of S/V ratio of the disposable pattern, wherein S is the surface area of the pattern and V is the volume thereof, to prevent the occurrence of a high-gloss carbon phenomenon.

4. An apparatus according to claim 3, wherein the regulating means comprises a pressure source (11), pressure regulating valve means (20) coupled to an outlet of the source, and a buffer reservoir (21) interposed between an outlet of the valve means and an inlet to the chamber.

5. An apparatus according to claim 4, wherein the buffer reservoir has a continuously open, permanent escape vent (23).

6. An apparatus according to claim 5, wherein the buffer reservoir is connected to the chamber by a duct (22) having a diameter substantially larger than that of the escape vent.

* * * * *